US006065532A

United States Patent [19]

Brownlee

[11] Patent Number: 6,065,532

[45] Date of Patent: May 23, 2000

[54] BOILER TUBE SHIELD

[75] Inventor: David Allen Brownlee, Brentwood, Tenn.

[73] Assignee: American Megatteaux Corp., Nashville, Tenn.

[21] Appl. No.: 09/238,144

[22] Filed: Jan. 28, 1999

Related U.S. Application Data

[60] Division of application No. 08/965,088, Nov. 28, 1997, Pat. No. 5,884,695, which is a continuation-in-part of application No. 08/640,128, Apr. 30, 1996, abandoned.

[51] Int. Cl.[7] ..... F28F 19/00

[52] U.S. Cl. ..... 165/134.1; 403/374.1; 122/DIG. 13

[58] Field of Search ..... 165/134.1; 138/110; 122/DIG. 13; 403/374.1, 374.2, 374.5, 409.1, DIG. 8

[56] References Cited

U.S. PATENT DOCUMENTS

| | | | |
|---|---|---|---|
| 2,646,818 | 7/1953 | Bimpson . | |
| 4,228,978 | 10/1980 | Rand . | |
| 4,619,314 | 10/1986 | Shimoda . | |
| 4,682,568 | 7/1987 | Green et al. . | |
| 4,776,790 | 10/1988 | Woodruff . | |
| 5,013,177 | 5/1991 | Sol | 403/235 |
| 5,154,648 | 10/1992 | Buckshaw . | |
| 5,220,957 | 6/1993 | Hance . | |
| 5,474,123 | 12/1995 | Buckshaw . | |
| 5,511,609 | 4/1996 | Tyler . | |
| 5,913,634 | 6/1999 | Heilig | 403/374.1 |

*Primary Examiner*—Allen Flanigan
*Attorney, Agent, or Firm*—Liniak, Berenato, Longacre & White, LLC

[57] ABSTRACT

A plurality of tube shields interlock with each other to protect the weld of a securement s strap used to secure the shields to a tube of a power plant. The tube shield comprises a semi-cylindrical longitudinally extending tube member terminating at a first and second end. The first end is provided with a tongue portion and a stepped portion. The second end is provided with a flanged portion and a pair of longitudinally extending bayonets. A securement strap is wound about a tube to be protected and the tongue portion of the tube shield. Each end of the securement strap is then welded to the tongue portion. A second tube shield is then placed adjacent to the first tube shield. The flanged portion of the second tube shield overlaps the tongue portion, securement strap, and stepped portion to provide protection from the hostile environment of the boiler. The bayonets are inserted between the boiler tube and the securement strap and provide a wedge-like interlocking assembly to securely fasten each tube shield to one another and to the boiler tube. Successive tube shields may be utilized to protect any desired length of tubing.

4 Claims, 10 Drawing Sheets

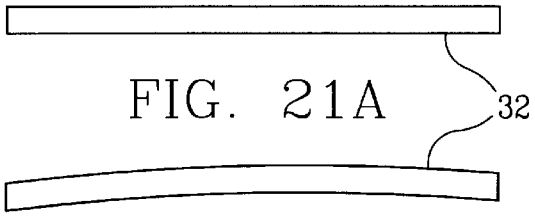
FIG. 21A
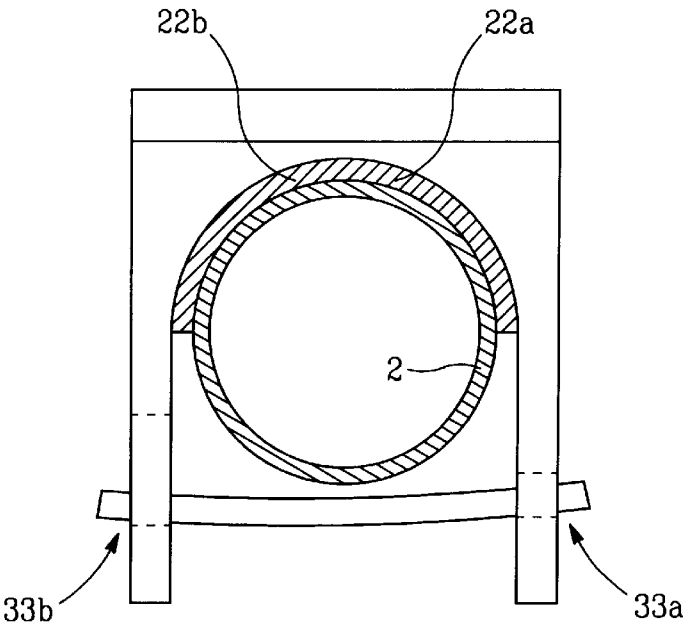
FIG. 21B
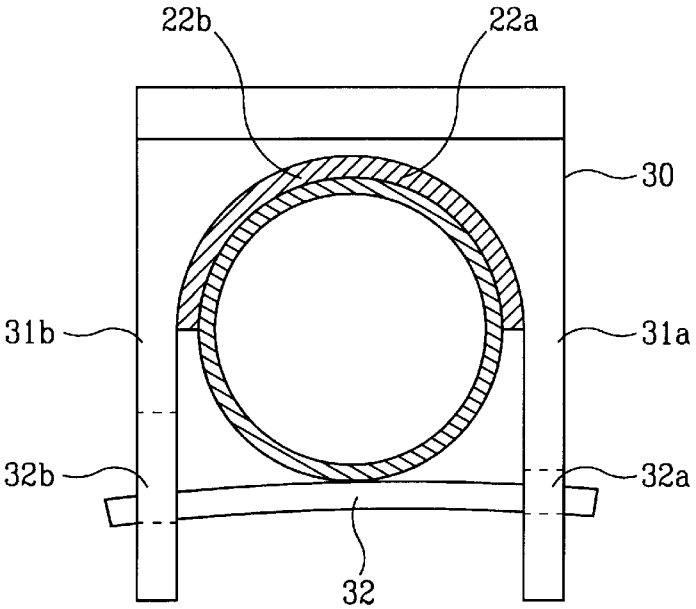
FIG. 22B
FIG. 22A

BOILER TUBE SHIELD

This is a divisional application of U.S. Ser. No. 08/965,088, filed Nov. 28, 1997, now U.S. Pat. No. 5,884,695 which in turn is a file wrapper continuation-in-part application of Ser. No. 08/640,128 filed Apr. 30, 1996, abandoned.

FIELD OF THE INVENTION

This invention relates to tube shields and more specifically to tube shields for protecting tubes of boilers and condensers in power plants from highly abrasive and corrosive environments.

DESCRIPTION OF THE PRIOR ART

Tubes are commonly used in various heat exchanger apparatuses such as boilers and condensers. Tubes employed in boilers are commonly exposed to highly abrasive and corrosive environments. Exposure of these tubes to such environments often has the result of premature failure resulting in expensive maintenance and boiler down-time costs.

Many shield type devices have been devised to protect the tubes from hostile environments. One type of shield device 20 includes an axially elongated protector of arcuate cross section. This device, or shield, is sized to fit over the tube to protect the portion of the tube which it embraces. A strap is then placed around the tube and welded to each side of the shield. This type of shield suffers in that the welds are exposed to the hostile environment and it is difficult to effectuate the weld due to space limitations.

A second method of attaching a common shield to the tubes is to use U-bolts to clamp the shield to the tube. This method requires a U-bolt and flat plate with two holes to bridge the tube and engage the U-bolt. This method is not desirous as the U-bolt is both costly and exposed to the hostile environment.

Another method of attaching such shields to the tubes is to directly weld the shield to the tube. However, because welding can cause unwanted metallurgic changes to the tubes a certified welder is required. In this method the weld is again exposed to the hostile environment which can lead to premature separation of the shield from the tube. These prior art tube shields are disclosed in U.S. Pat. No. 5,220,957 and is hereby incorporated by reference. A forth method involves a shield which is provided with holes located in appropriate positions such that once the shield is positioned adjacent the tube a rod is simply inserted through the holes to trap to the tube there between. The rod is subsequently welded to the shield. Here again the weld is exposed to the hostile environment.

A need, therefore, exists for a tube shield which protects a securement weld from the hostile environment of the boiler, and an interlocking tube shield which facilitates easy assembly.

SUMMARY OF THE INVENTION

This invention relates to an improved tube shield, which eliminates the drawbacks of the prior art. More specifically, this invention is directed to a tube shield which is capable of interlocking with a second tube shield and protecting the weld of a securement strap used to secure the shield to the tube. A longitudinally extending semi-cylindrical shield member is partially disposed about a tube to be protected. The shield member has an internal diameter substantially equal to the external diameter of the tube to be protected. The tube shield is provided with a first and second end. The first end of the shield member is provided with a tongue portion. A securement strap is disposed about the tube and the tongue portion of the shield member to secure the shield member to the tube. The second end of the shield member is configured to connect to the first end of another shield member, which has been secured to the tube by means of the strap.

The second end of the shield member has a semi cylindrical flanged portion. The flanged portion has an internal diameter substantially equal the external diameter of the tongue portion of the first end with the strap wound there around. When two shield members are connected to one another, the flanged portion overlaps the tongue portion. A pair of spaced apart longitudinally extending bayonets are provide to facilitate the connection between the two shield members. When to the second end of a shield member is connected to the first shield member, the bayonets are wedged between the securement strap and the tube to be protected. The bayonets serve the function of both securing the second shield member to the tube and to tighten the overall connection assembly.

The flanged portion overlaps both the tongue portion of the first end of the first shield member and the portion of the securement strap which overlaps the tongue portion. This configuration provides a single securement strap for attaching two shield members to a tube, thereby facilitating an easy assembly of several shield members to a tube. Tube shield members may be placed in succession one after the other to protect an entire length of a tube. The first shield member is simply placed adjacent a tube and a securement strap is wound there around.

A second end of a second shield member is then positioned adjacent to and urged toward the first shield member. The bayonets are then wedged between the securement strap and the tube. The process is repeated successively until the entire length of the tube is protected.

BRIEF DESCRIPTION OF THE DRAWINGS

FIGS. 21*a* and 21*b* represent top, front, and side views respectively, of a securement bar according to an alternative embodiment of the claimed invention.

FIG. 22(*a*) represents the securement cap and bar of FIGS. 19 and 21 attached to a tube shield and boiler tube in a clamped position.

FIG. 22(*b*) represents the securement cap and bar of FIG. 10 and 21 attached to a tube shield and boiler tube in a clamped position.

DETAILED DESCRIPTION OF THE PREFERRED EMBODIMENT

Figure 1:
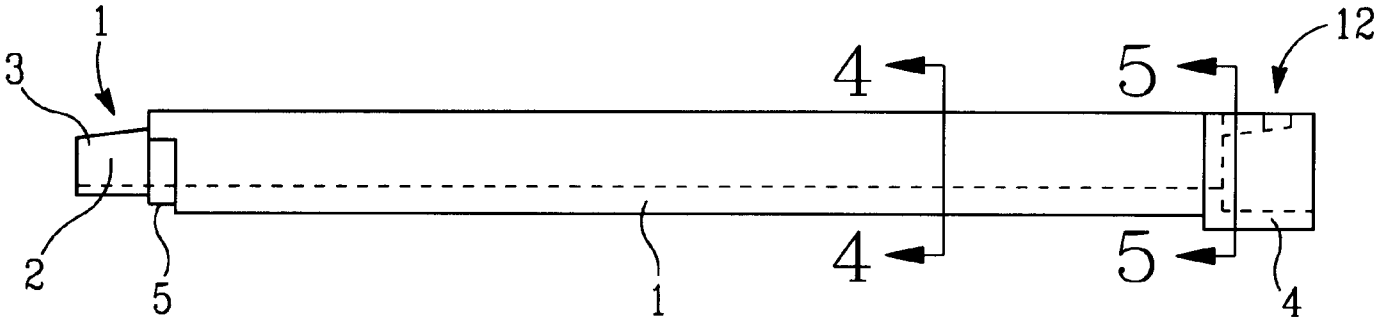
FIG. 1 is a side view of the tube shield according to the invention.
Figure 3:
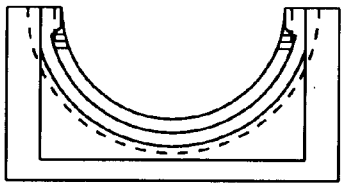
FIG. 3 is a right end view of the tube shield shown in FIG. 1.
Figure 2:
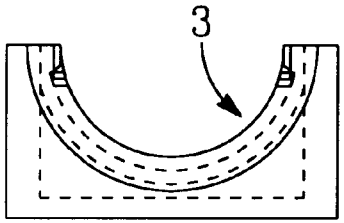
FIG. 2 is a left end view of the tube shield shown in FIG. 1.

FIG. 1 depicts a side view of the tube shield of the present invention. A longitudinally extending semi-cylindrical tube member 1 terminates at a first end 11 and a second end 12. The first end has a semi-cylindrical notched or stepped portion 5, which has a smaller external diameter than the semi-cylindrical member 1. Extending from the step portion 5 is a tongue portion 2. The semi-cylindrical tongue portion 2 sufficiently extends longitudinally to allow a securement strap to be wrapped there around. The external diameter of the tongue portion is smaller than the external diameter of the stepped portion. The tongue portion 2 has an angled portion 3 such that the amount that the tongue portion extends circumferentially diminishes as it extends from the tube member 1.

Figure 5:
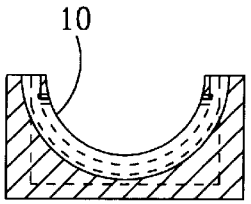
FIG. 5 is a cross sectional view taken along line 5—5 of FIG.
Figure 4:
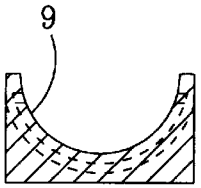
FIG. 4 is a cross sectional view taken along line 4—4 of FIG. 1.
Figure 6:
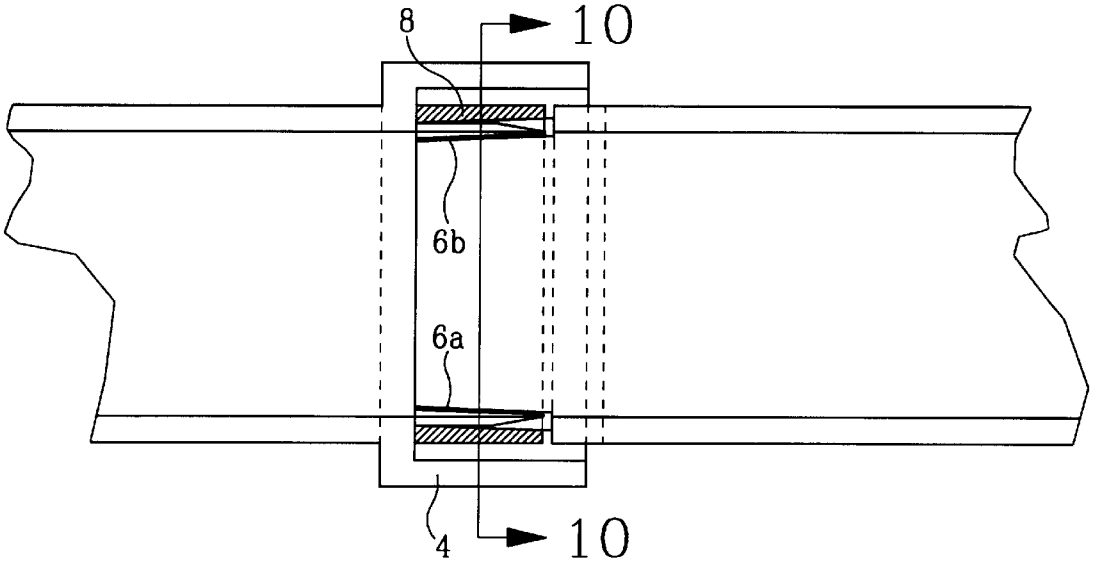
FIG. 6 is a top view of two assembled tube shields and a sectional view of the securement strap.
Figure 7:
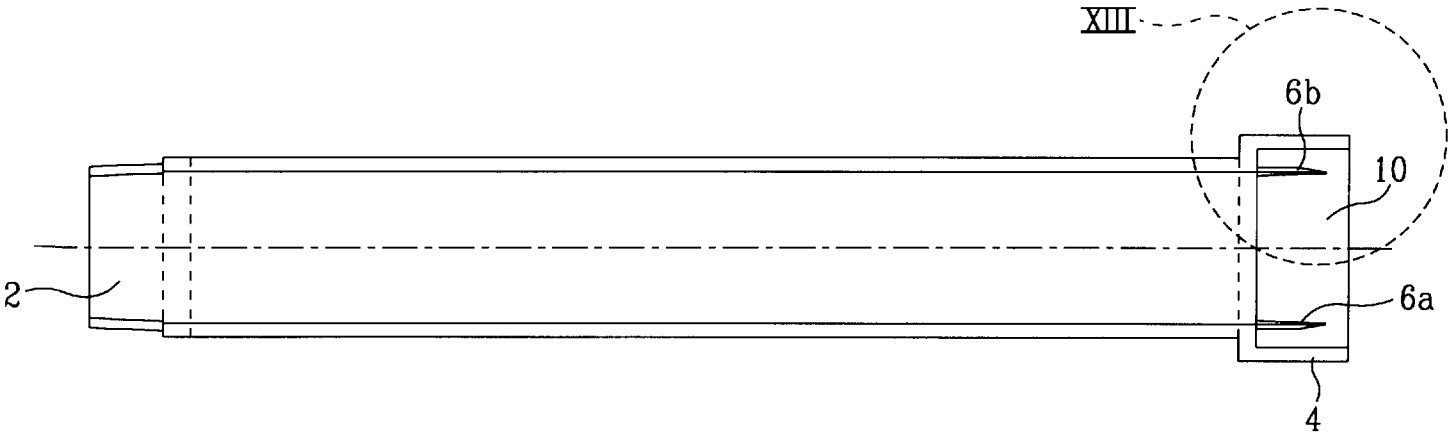
FIG. 7 is a top view of the tube shield of the present invention.
Figure 8:
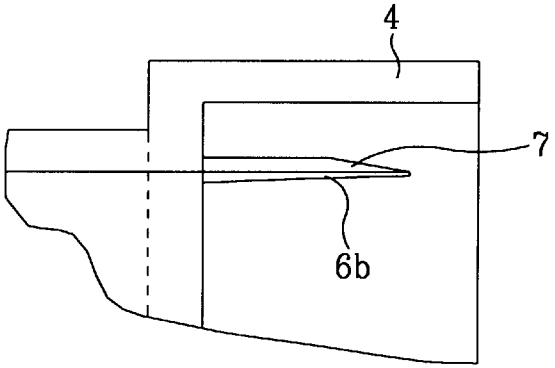
FIG. 8 is an exploded view of the second end of the shield.
Figure 9A:
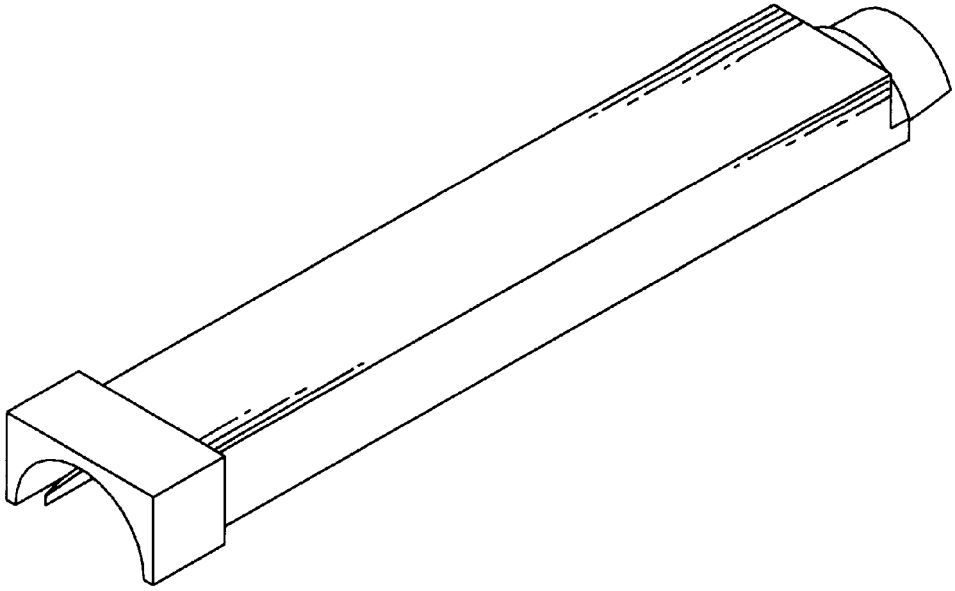
FIGS. 9*a–d* are perspective views of the tube shield of the present invention in different orientations.
Figure 9B:
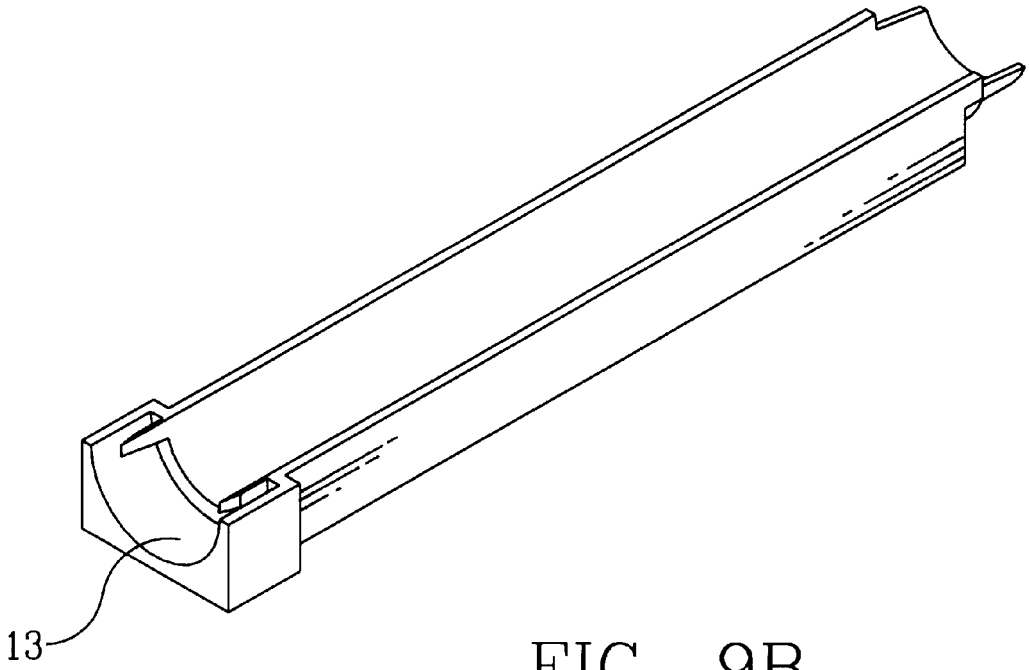
Figure 9C:
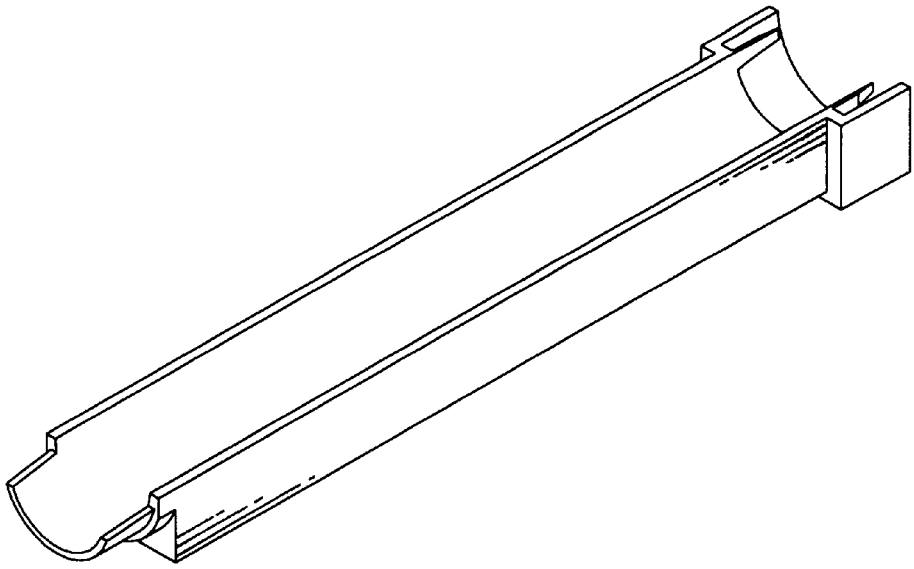
Figure 9D:
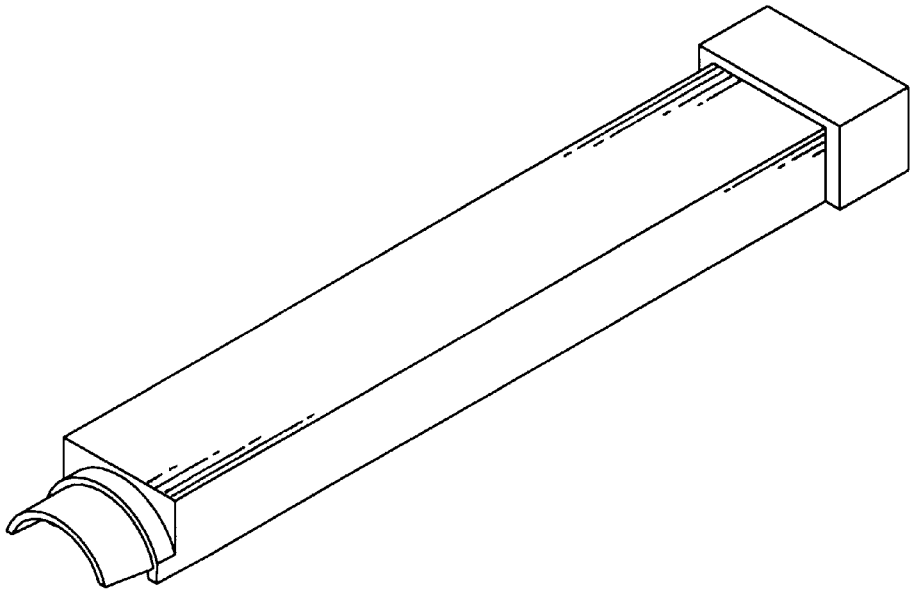

The second end 12 of the tube shield has a semi-cylindrical flange portion 4. The flange portion has an internal diameter 10 substantially equal to the external diameter of the stepped portion 5 (see FIG. 5). As shown in FIGS. 7 and 8, a pair of spaced apart bayonets 6*a,* 6*b* longitudinally extend from the semi-cylindrical member I disposed within the semi-cylindrical flange portion 4. The preferred embodiment contemplates a pair of bayonets, however it is understood that a single bayonet, or any number of bayonets, may be utilized. FIG. 8 depicts an enlarged view of the second end 12 of the tube shield revealing the relative position of the bayonet 6*b* with respect to the tube member 1, and flanged portion 1. The bayonet 6b is provided with an angled portion 7 such that the thickness (defined in a radial direction from internal surface 10 of the flanged portion 4) of the bayonet is progressively reduced along its length as it extends from the tube member 1. Additionally the bayonets 6*a,* 6*b* are provided with a second angled portion 13 such that its thickness is progressively reduced as it extends from the tube member 1 see FIG. 9*b*. The thickness of the second angled portion defined by a line perpendicular to both the axis of said tube member and a radial extending from the axis. The second angled portion 13 corresponds to the angled portion 3 of the tongue portion 2 such that when two tube shields are connected to one another the angled portion 13 of the bayonets contact the angled portion 3 of the tongue and form a wedge-like interface there between.

The assembly of the tube shield of the present invention to a boiler tube or the like will now be explained. The entire tube shield 15 is positioned against the surface of a tube to be protected such that the inner surface of the semi-cylindrical tube member I contacts the external surface of the tube. A metal strap is then wound about the tube and the tongue portion 2. Two ends of the strap and the outer surface of the tongue portion are welded together as depicted by weld portion 14 in FIG. 10. Because the securement strap S is not welded to the boiler tube, a certified welder is not required. Additionally, the position of the weld is accessible and facilitates an easy assembly. Welding is the preferred method of securing the securement straps 8 to the tongue 2. However, other means such as a bolt arrangement may be utilized.

A second tube shield is then positioned adjacent to the tube to be protected similarly to that of the first tube shield. The second tube shield is then slid toward the first tube shield. The second tube shield is further urged toward the first tube shield until the flange portion 4 completely overlaps the strap and stepped portion 5. The diameter of the semi-cylindrical flange 4 is preferably designed such that the internal surface 10 overlaps the tongue and securement strap and contacts the outer peripheral surface of the stepped portion 5. The flange portion 4 also completely covers the weld portion 14. Exposure of such welds to the hostile environment often results in premature failure putting the connection of the tube shield at risk. The flange portion 4 provides a protective covering which shields the weld from the hostile environment.

Figure 10:
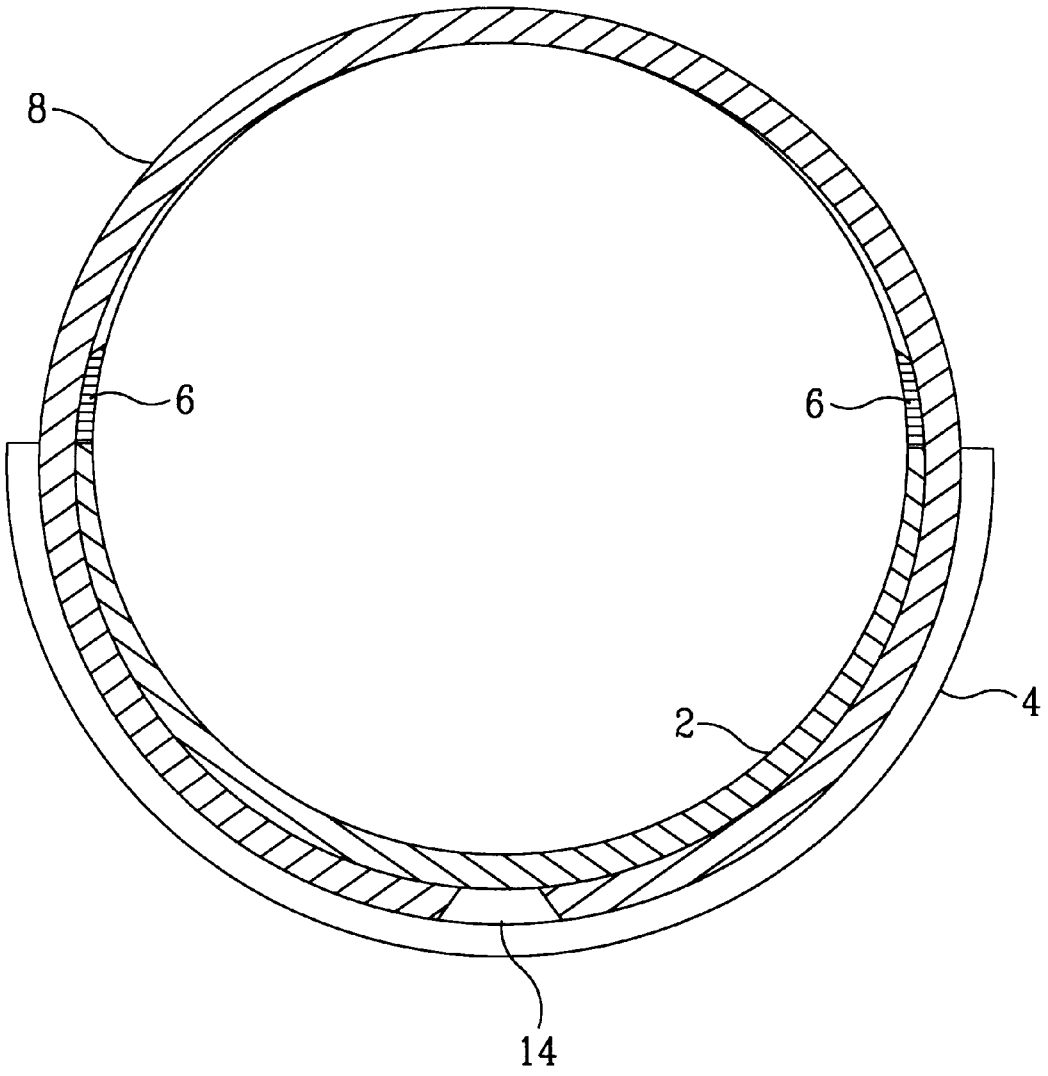
FIG. 10 is a cross section view of the connection of two tube shields taken along lined 10—10 of FIG. 6.

As the second tube shield is urged towards the first tube shield, the bayonets 6*a,* 6*b* are simultaneously inserted between the outer surface of the tube to be protected and the securement strap. FIG. 10 shows the relative positions of the tongue, securement strap 8, flange portion 4, and bayonets 6*a,* 6*b*. The bayonets 6*a,* 6*b* are formed such that they contact the tongue portion along the angled portion 3 of the tongue 2. This arrangement provides an important feature as the two angled pieces provide a wedge shaped interlocking fit. As the part of the assembly grow due to creep, the wedge effect will tighten the tube shield assembly to the tube by forcing the bayonet into the adjoining cut out portion occupied partially by the securement strap. This continued tightening effect will prolong the tube shield life by increasing tube contact and thus reducing the tube shield temperature. Creep is defined as the permanent expansion or growth of a part caused by exposure to high temperatures and stress over time.

Several tube shields are then similarly assembled to provide tube protection for a predetermined length of tubing. The interlocking of the tube shields when placed end to end provides a positive securement interlock between each other and the strap. The use of one strap to hold the end of two different tube shields results in each tube shield being held against the boiler tube in intimate contact at both ends. This increases the contact area of the tube shield with the tube and allows the boiler tube to absorb more heat, thus increasing the efficiency of the boiler and reducing the temperature of the shield which results in an increased life. This particular arrangement has also been shown to dramatically reduce the tendency of the tube shield to warp. Thus, an inexpensive secure attachment is achieved which is easy to assemble.

Figure 11:
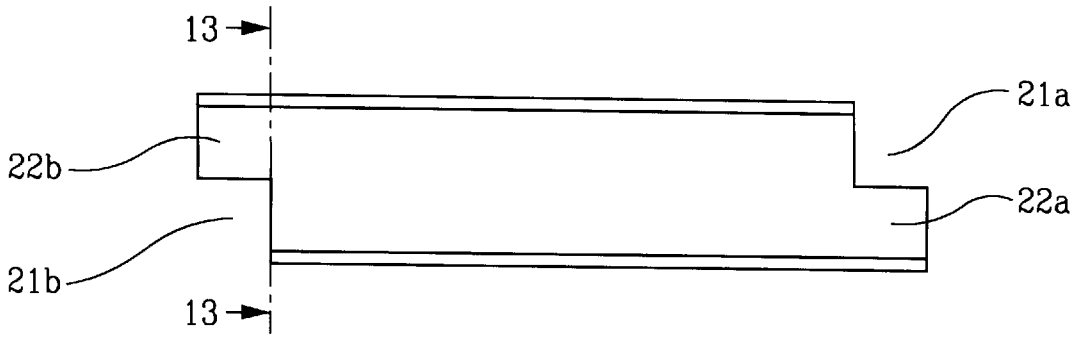
FIG. 11 is a top view of an alternative tube shield of the present invention.
Figure 12:
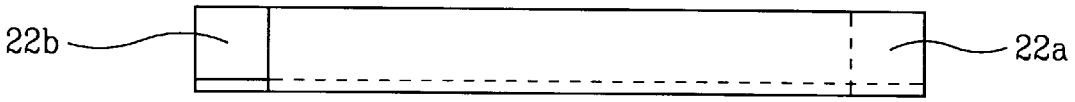
FIG. 12 is a side view of the alternative tube shield shown in FIG. 11.
Figure 13:
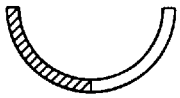
FIG. 13 is an end sectional view taken along line 13—13 of FIG. 11.
Figure 14:
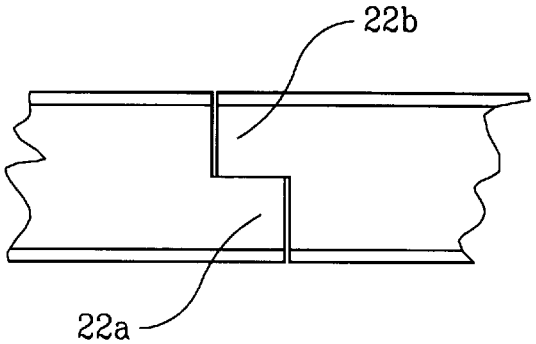
FIG. 14 is a partial top view of two alternative tube shields mounted adjacent to one another.

FIGS. 11–13 represent an alternative embodiment of the tube shield of the present invention. In this embodiment a simple semi-cylindrical tube shield 1 is formed with two notches 21*a*, 21*b* one each on either end of the tube shield. These notches 21*a,* 21*b* create two flanges 21*a,* 22*a*. The notches and flanged portions are formed to symmetrically mirror one another. That is when two tube shields 1 of the alternative embodiment are placed side by side, in a longitudinal direction, each flanged portion is positioned adjacent to a corresponding flange portion of the second tube shield. FIG. 14 represents the respective positions of each flanged portion with respect to a corresponding flanged portion of a successively placed tube shield.

Figure 15:
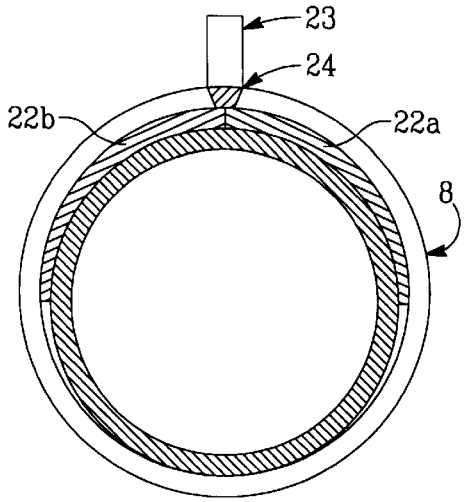
FIG. 15 is a cross sectional view of two alternative tube shields mounted to a boiler tube.
Figure 16:
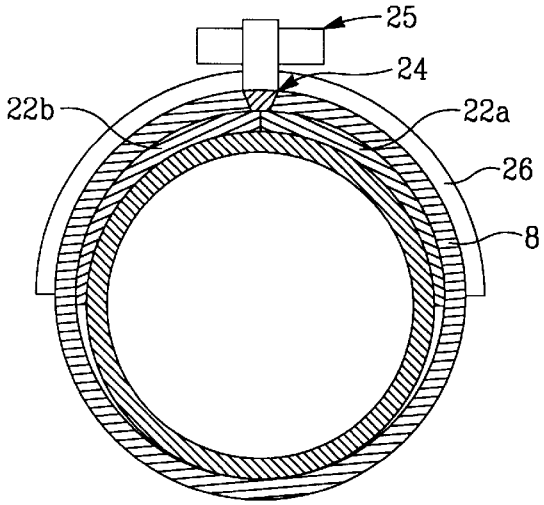
FIG. 16 is a cross sectional view of two alternative tube shields mounted to atube shield with a protective cover.

FIG. 15 represents a cross sectional view of two tube shields of the alternate embodiment secured to a boiler tube. Reference numerals 22*a,* 22*b* represent a flanged portion of each tube shield secured to the boiler tube. A securement strap 8 is wound about each flange portion and welded in place as indicated at 24. A retaining pin 23 is welded or otherwise attached to the weld juncture 24 which projects radially outward from the securement strap. As shown in FIG. 16, a protective cover member 26 is placed over the securement strap and weld to protect the weld juncture 24 from the hostile environment of the boiler. Preferably, an orifice extends through the thickness of the protective cover to allow the retaining pin 23 to extend through and beyond the protective cover 26. A retaining nut 25 or other member is attached to the retaining pin to secure the protective cover about the securement strap and weld juncture. This retaining nut 25 may be fastened to the retaining pin 23 by a threading relationship, a weld or other conventional attaching means.

Figure 17:
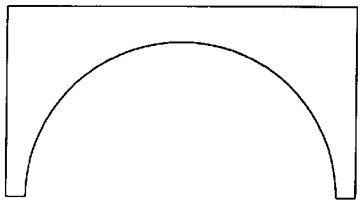
FIG. 17 and FIG. 18 represent end views of additional alternative embodiments of the tube shield.
Figure 18:
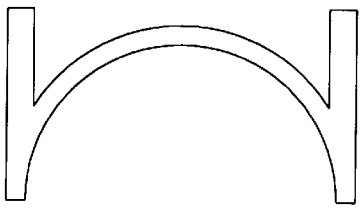

FIGS. 17–18 represent alternative external surface contours of the tube shield according to the present invention. While, the spirit of the present invention is not directed to the external surface contour of the tube shield, several embodiments are contemplated.

The heat shields can be made of different materials depending upon the hostility of the environment in which they will be exposed. Different grades of stainless steel or nickel/chrome alloys may be used. The securement strap is preferably made of a stainless steel.

Figure 19:
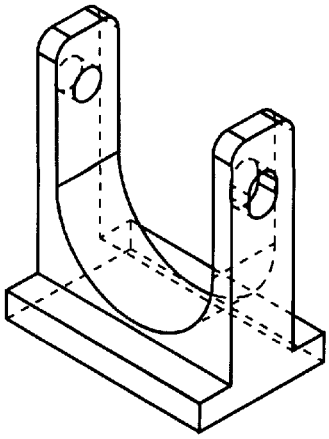
FIG. 19 represents a perspective view of a securement cap according to an alternative embodiment of the claimed invention.
Figure 20C:
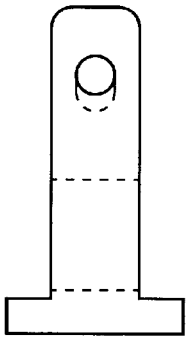
FIGS. 20*a,* 20*b,* 20*c* represent top, front, and side views respectively of the securement cap of FIG. 19.
Figure 20B:
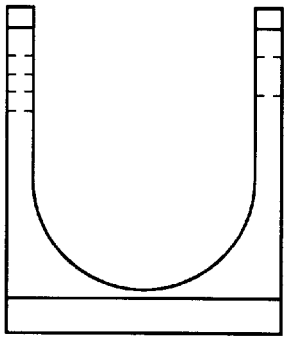
Figure 20A:
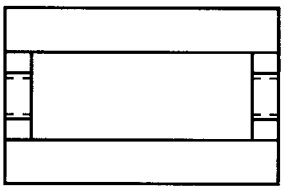

FIGS. 19–22*b* depict yet another alternative embodiment to the claimed invention. This embodiment is similar to the embodiment of FIGS. 13–16 with the securement strap being replaced by a securement cap 30 and bar 32. FIG. 19 represents a securement cap 30 having two support members 31*a* and 31*b* extending from a central portion defining a substantially U-shaped cap. FIGS. 21*a* and 21*b* represent an arcuate securement bar 32.

FIGS. 22*a* and 22*b* represent the assembly of the securement cap 30 and securement bar 32 which secures each of the engaging flanged portions 22*a* and 22*b* of adjacent tube shield to the boiler tube 2. The securement cap 30 is simply placed over and about the tube shield and boiler tube 2. The securement bar is inserted through an enlarged hole 32*b* in the extending arm 31*b* and through an opposite hole 32*a* in extending arm 31*a*. Hole 32*b* extends inward beyond that of hole 32*a* to facilitate insertion of the securement bar 32.

As demonstrated by FIG. 22*a,* the arcuate shape of the securement bar 32 and enlarged hole 32*b* facilitates easy assembly. The tube shield is clamped down onto the boiler tube 2 by rotating the securement bar 32 as demonstrated by FIG. 22*b*. The securement bar 32 may be held in place by tack welding the securement bar to the securement cap 30 as shown by welds 33*a,* 33*b*. The amount of clamping force depends upon the amount of rotation of the securement bar 32. FIG. 22*b* shows the securement bar 32 rotated 180 degrees thus exerted the maximum clamping force to the tube shield and boiler tube. It should be noted, that the radius of curvature of the securement bar 32 may be altered to obtain different tolerances between the completely unclamped and completely clamped positions of FIGS. 22*a* and 22*b*. By varying both the radius of curvature of the securement bar 32, the relative size and position of holes 33*a* and 32*b,* and the degree of rotation of the securement bar relative to the securement cap 30, different clamping forces may be generated as well as the ability to accommodate different size boiler tubes and corresponding tube shields.

In an alternate embodiment, the securement cap may be designed such that the inner diameter matches the external diameter of the boiler tube 2 and the securement bar 32 locks directly against the tube shields. In such an arrangement the securement cap 30 and securement bar 32 are rotated 180 degrees with respect to the tube shield and boiler tube 2 of FIGS. 22*a,* 22*b*.

While the tube shield of this invention has been shown and described with respect to a particular embodiment, it will be understood by those possessing skill in the art that various changes to the form and detail may be made therein without departing from the spirit and scope of the invention.

I claim:

1. A tube shield for protecting a tube having an external diameter, said tube shield comprising:

a semi-cylindrical shield member extending in a longitudinal direction having an internal diameter substantially equal to said external diameter of said tube and an external surface, said shield having a first and second end;

a plurality of flanges at least one longitudinally extending from each of said first and second ends, each of said flanges adapted to mate adjacent to a corresponding flange of a second shield member thereby maintaining a substantially continuous semi-cylindrical shield between two adjacent shield members whereby, said flanges are formed such that when one end of said tube shield is secured to said tube adjacent to a second end of a second tube shield, said one end of said tube shield and said second end of said second tube are positioned continuously adjacent to one another to inhibit exposure of said tube;

a U-shaped securement cap having two support arms extending from a central portion thereof, said U-shaped securement cap being disposed about said tube and said tube shield; and an arcuate securement bar rotatably supported between said support arms, whereby when said tube shield and said tube are disposed between said securement cap and securement bar, said securement bar may be rotated between an unclamped and a clamped position to clamp together said tube and said tube shield.

2. A tube shield for protecting a tube having an external diameter, said tube shield comprising:

a shield member extending in a longitudinal direction having an internal diameter substantially equal to said external diameter of said tube;

and a retaining means for retaining said shield member to said tube, said retaining means connected to said shield member having a pair of arms disposed on opposite sides of said tube and extending below said tube, and an arcuate securement bar rotatably supported between said arms, whereby when said tube is disposed within said shield member and arcuate securement arm, said arcurate securement bar may be rotated between a clamped and unclamped position to clamp to together said tube and said tube shield.

3. The tube shield according to claim 2, wherein said securement bar extends through an aligned bore of each of said arms.

4. A method of securing the tube shield of claim 3 to said tube, said method comprising the steps of:

disposing said shield member about said tube;

inserting said arcuate bar through said bores;

rotating said arcuate securement bar to said clamped position to thereby firmly clamp said tube between said securement bar and said shield member; and welding said securement bar to said one of said arms to prevent relative rotation there between and maintain said securement bar in said clamped position.

* * * * *